United States Patent [19]
Englund et al.
[11] 4,317,635
[45] Mar. 2, 1982

[54] MATRIX PRINTING HEAD

[75] Inventors: Roland Englund, Stockholm; Tommy Wincent, Upplands Väsby, both of Sweden

[73] Assignee: Svenska Kassaprinter AB, Sundbyberg, Sweden

[21] Appl. No.: 119,224

[22] Filed: Feb. 7, 1980

[30] Foreign Application Priority Data

Feb. 13, 1979 [SE] Sweden ..... 7901264

[51] Int. Cl.[3] ..... B41J 3/12
[52] U.S. Cl. ..... 400/124; 101/93.05
[58] Field of Search ..... 400/124; 101/93.05, 101/93.33, 93.34, 93.48

[56] References Cited

U.S. PATENT DOCUMENTS

| | | | |
|---|---|---|---|
| 3,631,797 | 1/1972 | Johnston et al. | 101/93.33 X |
| 3,828,908 | 8/1974 | Schneider | 400/124 |
| 3,973,661 | 8/1976 | De Boo et al. | 400/124 |
| 3,982,622 | 9/1976 | Bellino et al. | 400/124 |
| 4,005,770 | 2/1977 | Hirose et al. | 400/124 |

FOREIGN PATENT DOCUMENTS

| | | | |
|---|---|---|---|
| 2056364 | 5/1976 | Fed. Rep. of Germany | 400/124 |
| 2628944 | 2/1977 | Fed. Rep. of Germany | 400/124 |

*Primary Examiner*—Paul T. Sewell
*Attorney, Agent, or Firm*—Robert F. Rotella

[57] ABSTRACT

In a matrix printing head (1) including at least one printing needle (9), an electromagnet (2), which is provided with an armature (4) co-operating with the printing needle for moving the latter towards a printing position, and a spring (6) for returning the needle in a direction from the printing position, the printing needle is pivotably and detachably connected to the armature (4) by means of said spring (6). The pivotable connection is accomplished by the printing needle (9) being provided with a curved end (9*b*) pivotably supported in a groove (4*c*) in the armature (4). The curved end of the needle is retained in this groove by means of said spring (6). The armature (4) is pivotably supported in a notch (5*b*) in a yoke (5) carrying a plurality of electromagnets (2) and is detachably supported in the notch by means of said spring (6).

4 Claims, 2 Drawing Figures

MATRIX PRINTING HEAD

BACKGROUND OF THE INVENTION

1. Field of the Invention

The present invention relates to a device in a matrix printing head with at least one printing needle, one electromagnet, which is provided with an armature co-operating with the needle for moving the latter towards a printing position, and spring means for returning the needle in a direction from the printing position.

2. Description of the Prior Art

A plurality of devices described above are known in the art. In most devices each printing needle is fixed to a pivotable armature which pivots in an arcuate path each time the electromagnet is energized and de-energized, respectively. Depending on the rigid connection between the armature and the needle the connection, the needle and/or the armature are subjected to stresses, which will wear and/or damage these elements and even break them. Moreover, the rigid connection has made impossible an exchange of the armature only or the needle only in the case one of these elements has been broken and has made more difficult the mounting of the elements in the printing head.

In order to solve the two problems described above it has been proposed in Swedish Pat. No. 76 06230-6 to detachably connect the armature to the printing needle. This means that the needle or the armature can be exchanged and the mounting of these elements can be made easier. However, the detachable connection between the armature and the needle acts as a rigid connection during the work of the printing head because no movement between the armature and the needle is possible. The change of the angle between these elements during the pivoting movement of the armature is accomplished by bending the needle near the armature. This bending relatively quickly fatigues the printing needle so that it will be broken.

SUMMARY OF THE INVENTION

The object of the present invention is to provide a device in a printing head described above which removes the above indicated disadvantages of previously known devices. This object is fulfilled by the printing needle being connected to the armature by means of a spring means a portion of which acts at the point where the printing needle is pivotably connected to the armature.

The advantages of this embodiment are that neither the printing needle, the armature nor the connection between these elements will be subjected to stress or forces decreasing the life of the device and that the mounting and/or exchange of individual elements in the device can be performed easily. Further, the connection between the printing needle and the armature will be strong and reliable.

The advantage of that which is stated in claims 2 and 4 is that only one single spring is needed to perform more than one function.

The advantages of the present invention are the freedom from play of the armature and that the armature always is in contact with one of the pole shoes of the electromagnet. This improves the propagation of the magnetic field to the armature. Moreover, the armature may be easily disconnected from the magnet and from the printing needle.

The advantage of the present invention is that the surface pressure between the armature and the printing needle will be low and that the needle will be oriented in a correct position in relation to the armature.

The advantage of the present invention is that the manufacture of the yokes of the electromagnets will be inexpensive, that the mounting thereof will be easier and that the distribution of heat and magnetic flux will be more uniform.

DETAILED DESCRIPTION OF THE PREFERRED EMBODIMENT

Figure 1:
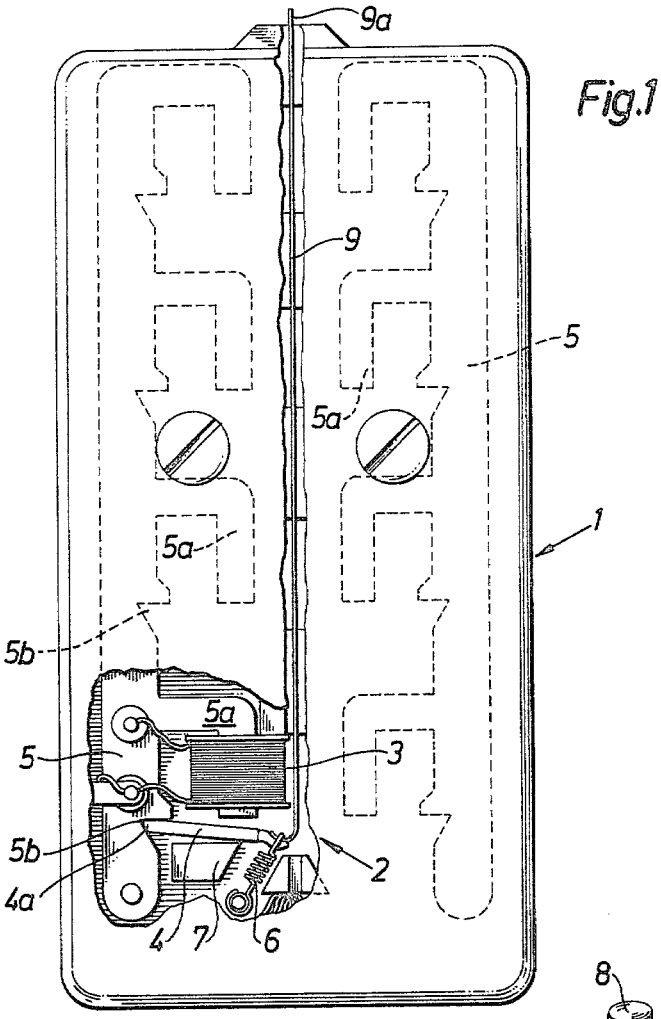
FIG. 1 is a view of a matrix printing head seen from above, an upper portion of the head has been cut away to show an embodiment of the device according to the invention.

The matrix printing head shown in FIG. 1 is designated 1 and includes seven electromagnets 2 one of which is shown. Each magnet 2 includes a solenoid 3, an armature 4 and a yoke 5 made of ferrite material. The yoke 5 is common to all magnets 2 in a row parallel to the longitudinal axis of the printing head and is provided with L-formed projections 5*a* forming pole shoes on which the solenoids are mounted. There are two rows of magnets 2 and thus two yokes 5 in the printing head 1.

Each armature 4 is provided with a pointed end 4*a* pivotably mounted in a notch 5*b* in the yoke 5, the notch being generally V-formed. The end 4*a* is kept in engagement with the notch 5*b* by means of a helical tension spring 6, the spring force of which being so directed that one force component strives to pivot the armature 4 clockwise about the end 4*a* in the notch 5*b* and another force component strives to press this end against the bottom of the V-formed notch. The clockwise pivotal movement of the armature 4 is limited by a support 7 located between the ends 4*a* and 4*b* of the armature and fixed in the printing head. The support 7 also is a pivot point for the armature which acts as a double-armed lever.

One end 6*a* of the spring 6 is detachably connected to a pin 8 (see FIG. 2) protruding from the bottom of the printing head, and the other end of the spring is formed as a ring 6*b* almost closed and enclosing the end 4*b* of the armature 4.

Figure 2:
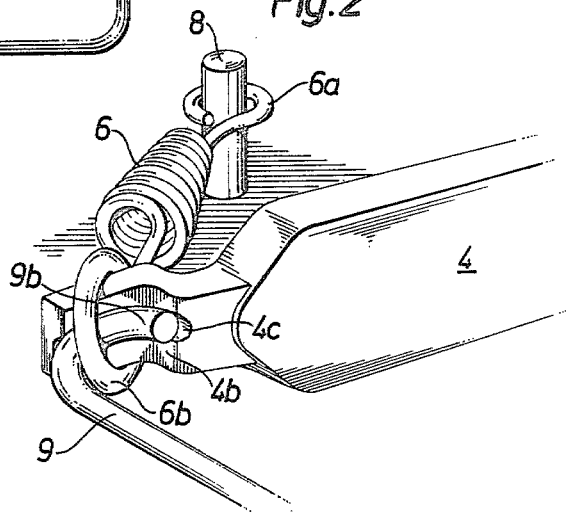
FIG. 2 is a perspective view showing details of the device according to FIG. 1 on an enlarged scale.

A printing needle 9 is detachably connected to each armature 4. The needles are carried for reciprocal motion in the printing head 1. The needles receive a movement upwards in FIG. 1 towards a data record (not shown), located in front of the printing head, when the pertaining electromagnets are energized to print a matrix pattern of dots on the data record with their front ends 9*a*. Each needle 9 has a curved rear end formed as a hook 9*b* the side of which nearest the armature being located in a groove 4*c* in the armature. The groove has the same radius of curvature as the hook and is sufficiently deep to prevent vertical movement of the hook 9*b* (FIG. 2) in relation to the armature 4. The hook 9*b* is retained in engagement with the groove 4*c* because the ring 6*b* encloses the armature 4 and the hook, and the ring is pressed against the hook by means of the force of the spring 6. This is shown in FIG. 2.

Depending on the curved end 9*b* of the needle and the corresponding form of the groove 4*c*, the armature 4 will be pivoted relatively to the needle without any friction to speak of and without any break of the armature and needle when the latter is reciprocated towards and from the data record. During this movement the end 9*b* is kept in engagement with the groove 4*c* by means of a predetermined force of the spring 6.

The spring has three different functions, i.e. retaining the hook 9*b* in the groove 4*c*, retaining the end 4*a* of the armature 4 in the notch 5*b* and the resetting of the armature to the position shown in FIG. 1 into contact with the support 7 after the printing needle has performed a printing movement and the electromagnet 2 has been deenergized. The spring can easily be removed from the printing head by lifting its end 6*a* upwards out of engagement with the pin 8 and by widening the ring 6*b* thereof so that the distance between the free end of the ring and the end of the ring connected to the spring will be increased whereupon the ring can be detached from the end 4*b* of the armature and from the hook 9*b*. Hereby, also the armature and the needle 9 are detached from their connections and may be removed from the printing head 1.

Even though only one embodiment of the invention has been described above and shown on the drawings it should be understood that the invention is not limited to this embodiment. Other embodiments and modifications of the embodiment described and shown are possible, and the invention is thus only limited to that which is stated in the claims.

We claim:

1. A matrix printing head, comprising:

at least one printing needle;

an electromagnet provided with an armature to which an end of said printing needle is pivotally connected and which moves the printing needle towards a printing position;

spring means for restoring the printing needle in a direction away from said printing position;

said printing needle end being connected said armature by means of said spring means;

said printing needle end being provided with a curved portion forming a holder for said spring means;

said curved portion also being pivotably supported by a groove formed in said armature.

2. A matrix printing head as set forth in claim 1, wherein:

said spring means comprises a single helical spring, one end of which is detachably mounted to said printing needle end.

3. A matrix printing head as set forth in claim 1, wherein:

said electromagnet further comprises yoke means;

said armature being provided with a second end oppositely of said printing needle end is detachable from and pivotably supported in a generally V-formed notch provided in said yoke means;

said spring means also adapted to retain said second end of said armature in engagement with said notch.

4. A matrix printing head as set forth in claim 1, wherein:

said helical spring is disposed at an acute angle relative to the longitudinal axis of said printing needle.

* * * * *